US007455508B2

(12) United States Patent
Suefuji et al.

(10) Patent No.: US 7,455,508 B2
(45) Date of Patent: Nov. 25, 2008

(54) SCROLL TYPE FLUID MACHINE HAVING COUNTER WEIGHT PROVIDED ON DRIVING BUSH AND SUB WEIGHT RADIALLY PROTRUDING FROM ROTARY SHAFT

(75) Inventors: Kazutaka Suefuji, Kawasaki (JP); Shunsuke Mori, Yokohama (JP); Junichi Nagasawa, Kamakura (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/727,516

(22) Filed: Mar. 27, 2007

(65) Prior Publication Data

US 2007/0231175 A1 Oct. 4, 2007

(30) Foreign Application Priority Data

Mar. 31, 2006 (JP) ..... 2006-099485

(51) Int. Cl.
*F01C 21/00* (2006.01)
*F03C 2/00* (2006.01)

(52) U.S. Cl. ..... 418/151; 418/55.1; 418/55.5; 418/57

(58) Field of Classification Search ..... 415/55.1–55.6, 415/57, 151; 418/55.1–55.6, 57, 151
See application file for complete search history.

(56) References Cited

U.S. PATENT DOCUMENTS 5,165,879 A * 11/1992 Kondo et al. ..... 418/55.5
5,201,646 A * 4/1993 Dees et al. ..... 418/55.5
5,366,360 A * 11/1994 Bookbinder et al. ..... 418/151
5,452,995 A * 9/1995 Izumi et al. ..... 418/151
5,547,354 A * 8/1996 Shimizu et al. ..... 418/151

FOREIGN PATENT DOCUMENTS

JP 58-124692 8/1983
JP 58124692 U * 8/1983
JP 01081501 A * 3/1989 ..... 418/151
JP 05149271 * 6/1993 ..... 418/151
JP 06147148 * 5/1994 ..... 418/55.5

* cited by examiner

*Primary Examiner*—Theresa Trieu
(74) *Attorney, Agent, or Firm*—Wenderoth, Lind & Ponack, L.L.P.

(57) ABSTRACT

A scroll type fluid machine having a driving system including a counter weight and a sub weight, in which an efficiency of an assembling operation is enhanced by simplifying an assembling structure of the driving system. In the fluid machine, a sub weight (17) is provided on a rotary shaft (16) and a counter weight (20) is provided on a driving bush (19). The driving bush (19) is attached to the rotary shaft (16) by an attachment bolt (23) to prevent relative rotation between the rotary shaft and the driving bush. The rotary shaft (16) supported by a main bearing (18) and is driven in rotation by a motor (9), with the result that an orbiting scroll (4) performs an orbiting motion with respect to a fixed scroll (2).

8 Claims, 9 Drawing Sheets

SCROLL TYPE FLUID MACHINE HAVING COUNTER WEIGHT PROVIDED ON DRIVING BUSH AND SUB WEIGHT RADIALLY PROTRUDING FROM ROTARY SHAFT

BACKGROUND OF THE INVENTION

The present invention relates to scroll type fluid machinery suitable to be used in air compressors, vacuum pumps, and the like.

In general, as one of scroll type fluid machinery, for example, a scroll type compressor in which an orbiting scroll performs an orbiting motion with respect to a fixed scroll by means of a drive source such as a motor to thereby compress air is known (for example, refer to Japanese Utility Model Application Laid-open No. (SHO)58-124692).

Such a conventional scroll type compressor comprises a substantially cylindrical casing, a fixed scroll provided on the casing and having a spiral wrap portion extending from a front surface of an end plate, and an orbiting scroll opposed to the fixed scroll within the casing and having a spiral wrap portion extending from a front surface of an end plate.

The wrap portion of the fixed scroll and the wrap portion of the orbiting scroll are disposed in an overlapped relationship with each other so that a plurality of compression chambers are defined between the wrap portions. Further, a rotary shaft rotated by the drive source is provided within the casing and is rotatably supported by a main bearing disposed within the casing.

Further, the rotary shaft is provided at its leading end with a crank portion eccentric radially from the rotary shaft by a predetermined eccentric amount, and the crank portion is connected to the orbiting scroll via an orbit bearing or the like. In a compressing operation, when the rotary shaft is rotatingly driven, the orbiting scroll performs an orbiting motion around an axis of the rotary shaft with a predetermined orbiting radius, with the result that the air is compressed in the compression chambers defined between the fixed scroll and the orbiting scroll.

On the other hand, a counter weight for achieving weight balance between the counter weight and the orbiting scroll performing an orbiting motion is attached to the drive shaft, and this counter weight is disposed on a radially opposite side of the center of the rotary shaft from the center axis of the orbiting scroll.

Further, the orbiting scroll and the counter weight are spaced apart from each other in the axial direction of the rotary shaft with the interposition of the main bearing and the orbit bearing. As a result, when the orbiting scroll and the counter weight are rotated around the rotary shaft, centrifugal forces applied to these elements act as an external force (moment force) tending to tilt the rotary shaft obliquely.

Thus, in the conventional art, a sub weight is attached to the drive shaft so that the moment force tending to tilt the rotary shaft is cancelled by the sub weight. In this case, the sub weight is spaced apart from the counter weight in the axial direction and is disposed on a radially opposite side of the rotary shaft from the counter weight.

By the way, in the above-mentioned conventional art, it is designed so that the rotary shaft of the compressor is rotatably supported by the main bearing and the counter weight and the sub weight are attached to the rotary shaft on axially opposite sides thereof with the interposition of the main bearing.

However, when the compressor is assembled, parts such as the counter weight, sub weight and main bearing must be assembled to the outer periphery of the rotary shaft separately. In addition, in the assembling operations of the counter weight and the sub weight, assembling positions of these weights must be set or adjusted so that the counter weight is disposed on the radially opposite side of the center of the rotary shaft from the center axis of the orbiting scroll and the sub weight is disposed on the radially opposite side of the rotary shaft from the counter weight (that is to say, the sub weight is disposed on the same side as the center axis of the orbiting scroll).

Thus, in the conventional arts, for example, the assembling structures of the rotary shaft, counter weight, sub weight, main bearing and the like are complicated, and, since it takes a long time to assemble these parts with predetermined positional relationships, there arises a problem that working efficiency and productivity are lowered.

The present invention has been made in view of the above-mentioned conventional art problems, and an object of the present invention is to provide a scroll type fluid machine in which an assembling structure of a rotary shaft, a main bearing, a counter weight, a sub weight and the like can be simplified and a whole assembling operation for these parts can be performed efficiently.

SUMMARY OF THE INVENTION

In order to solve the above problems, the present invention is applied to a scroll type fluid machine comprising a casing, a fixed scroll provided on the casing and having an end plate and a spiral wrap portion extending from the end plate, and an orbiting scroll opposed to the fixed scroll within the casing and having an end plate and a spiral wrap portion extending from the end plate, the wrap portion of the orbiting scroll overlapping the wrap portion of the fixed scroll.

According to the present invention, the scroll type fluid machine comprises a driving bush which is non-rotatably attached to one end of a rotary shaft and to which the orbiting scroll is attached via an orbit bearing at a position eccentric radially from an axis of the rotary shaft, and a counter weight provided on the driving bush and having a center of gravity located on a radially opposite side of a center of the rotary shaft from a center axis of the orbiting scroll.

Further, according to the present invention, the driving bush, has a shaft hole into which one end of the rotary shaft is inserted, and the rotary shaft is non-rotatable within the shaft hole.

Further, the driving bush is provided with a washer attachment groove disposed around the shaft hole, and a washer is received in to the washer attachment groove by an attachment bolt.

Further, according to the present invention, the driving bush is provided with a washer attachment groove formed around the shaft hole, and the machine further comprises a washer having a bolt receiving hole at a position eccentric radially from the axis of the rotary shaft and being received in the washer attachment groove; an engagement portion provided between the driving bush and the washer to prevent the driving bush and the washer from rotating relative to each other; and an attachment bolt inserted through the bolt receiving hole and screwed into the one end of the rotary shaft.

Further, according to the present invention, another engagement portion is provided between the rotary shaft and the washer to prevent a relative rotation between the rotary shaft and the washer.

Further, according to the present invention, the driving bush is provided with a boss portion to which the orbiting scroll is attached via an orbit bearing and is designed so that inner diameters of the boss portion, washer attachment groove and shaft hole are reduced in order.

Further, according to the present invention, the main bearing is constituted by arranging two ball bearings each having an inner race and an outer race, the two ball bearing arranged side by side in an axial direction, and the two inner races are gripped in the axial direction by a force for attaching the driving bush to the rotary shaft.

Further, according to the present invention, the boss portion of the driving bush is provided at its inner periphery with a straight portion extending in parallel with a diametrical line connecting a center of the shaft hole and a center of the boss portion.

According to the present invention, by attaching the driving bush having the counter weight to the rotary shaft having the sub weight, not only the rotary shaft, sub weight, driving bush and counter weight, but also, for example, the main bearing attached to the rotary shaft and the casing to which the main bearing is attached can be integrated. Accordingly, the assembling structure of these parts can be simplified and plural parts can be assembled efficiently.

Further, for example, the sub weight can previously be integrally formed or assembled on the rotary shaft at a proper position. On the other hand, similarly, the boss portion and counter weight for the orbiting scroll can also be arranged previously on the driving bush as a proper position. With this arrangement, only by assembling the rotary shaft and the driving bush to each other, positional relationships between the orbiting scroll and the counter weight and the sub weight in the rotational direction can be adjusted accurately. Thus, during the assembling of the fluid machine, it is not necessary that the positional relationships between these parts be set and adjusted, for example, by using any positioning keys or pin-shaped tools, excessive operations or processes can be eliminated, thereby enhancing the working efficiency.

Further, for example, also at the stage before the drive source is mounted, the weight balance in the rotational direction can be determined at the stage when the rotary shaft, driving bush, orbiting scroll and the like are assembled. Accordingly, for example, since it is not necessary that another weight be attached to the drive source and the positioning of such a weight be performed, the assembling operation can be simplified, thereby enhancing the productivity. Further, for example, by forming the rotary shaft and the sub weight integrally with each other and by forming the driving bush and the counter weight integrally with each other, the number of parts can be reduced, thereby suppressing the production cost.

BRIEF DESCRIPTION OF THE DRAWINGS

FIG. 3 is an exploded longitudinal sectional view showing a casing, a motor, the rotary shaft, a main bearing, the driving bush and the like;

FIG. 4 is a front view showing the driving bush, a counter weight, a washer and the like;

FIG. 9 is an exploded perspective view showing the rotary shaft, a sub weight, the washer and the like;

DESCRIPTION OF THE PREFERRED EMBODIMENTS

Figure 1:
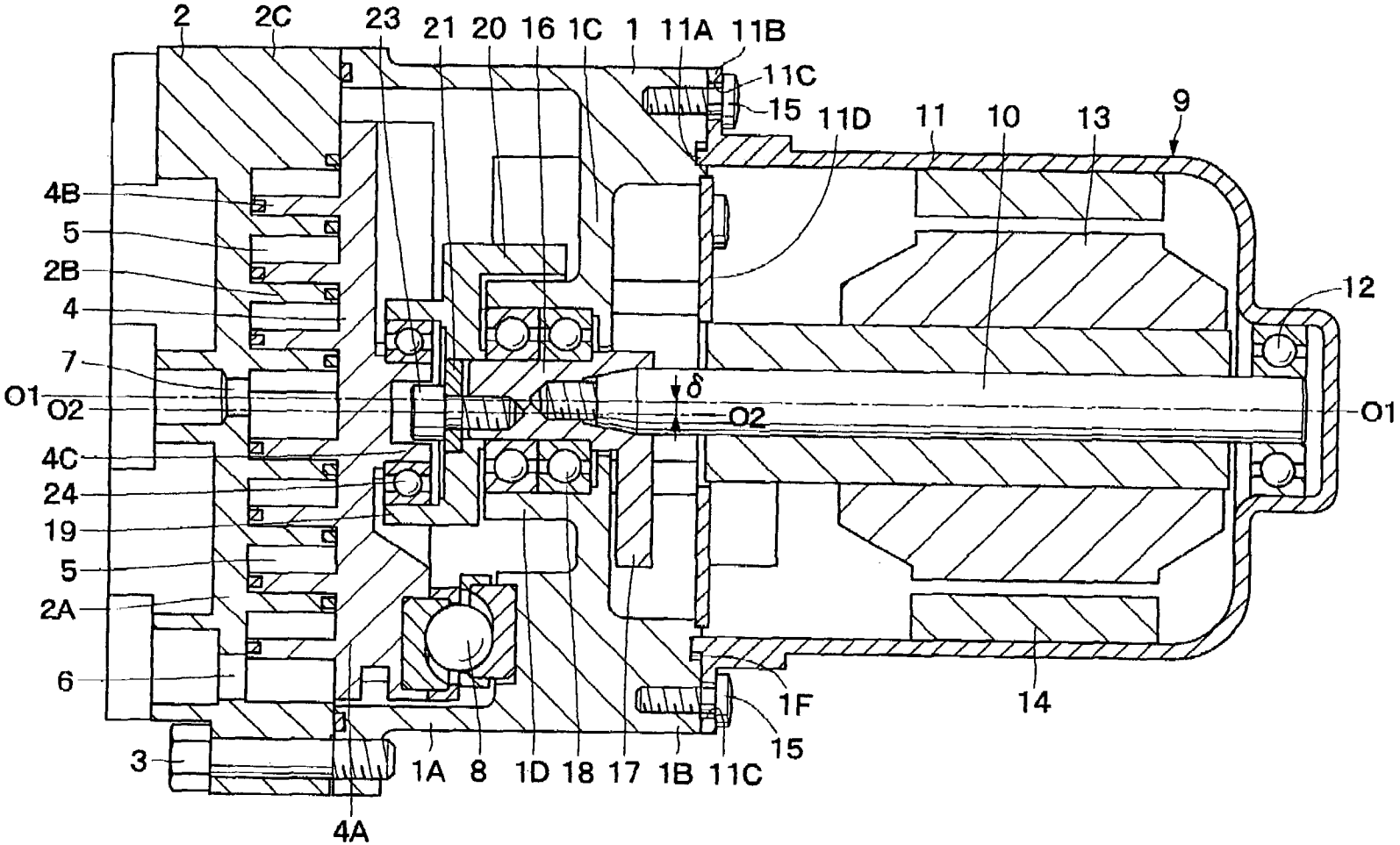
FIG. 1 is a longitudinal sectional view showing a scroll type air compressor according to a first embodiment of the present invention.

Now, embodiments of a scroll type fluid machine according to the present invention will be fully explained with reference to the accompanying drawings.

FIGS. 1 to 5 show a first embodiment which is embodied as a scroll type air compressor.

The compressor comprises a casing 1 forming an outer shell of the compressor, which casing is formed as a stepped cylindrical member having both axial open ends. The casing 1 is generally constituted by a scroll side cylindrical portion 1A having an axial open one end (opened toward a fixed scroll 2 which will be described later), a motor side cylindrical portion 1B provided at the other axial end of the scroll side cylindrical portion 1A (and opened toward a motor 9 which will be described later), an annular partition wall portion 1C disposed between the scroll side cylindrical portion 1A and the motor side cylindrical portion 1B and protruded radially inwardly from an inner peripheral surface of the casing 1, and a bearing attachment portion 1D having a bottomed cylindrical shape and protruded axially from a central portion of the partition wall portion 1C toward the scroll side cylindrical portion 1A.

Within the scroll side cylindrical portion 1A, there are provided an orbiting scroll 4 which will be described later, a rotation preventing mechanism 8, a driving bush 19, a counter weight 20 and the like. Further, the motor side cylindrical portion 1B is opened at the other axial end of the casing 1, and a sub weight 17 which will be described later is housed within the motor side cylindrical portion.

Figure 2:
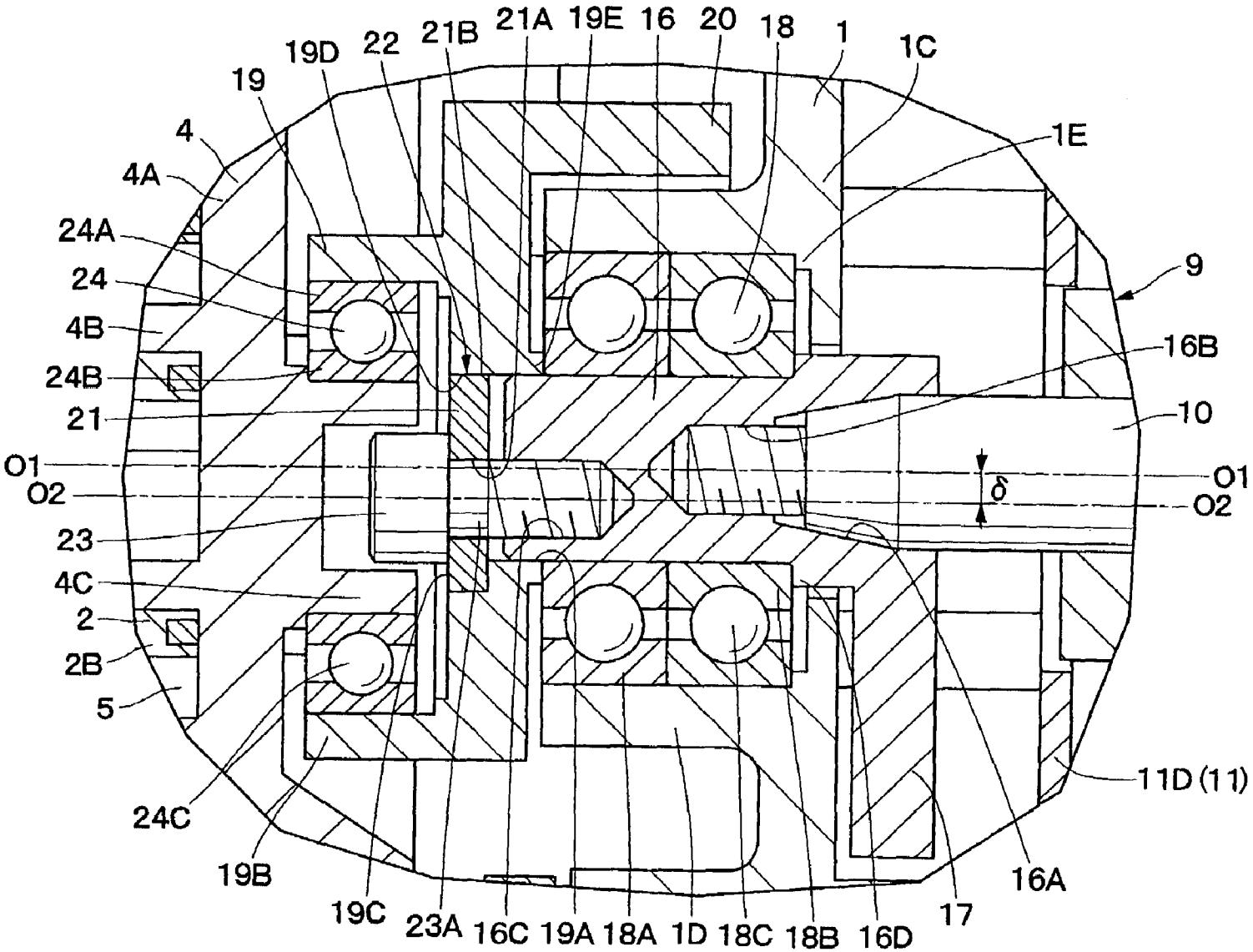
FIG. 2 is an enlarged sectional view showing parts of a connection section between a rotary shaft and a driving bush in FIG. 1 with an enlarged scale.

Further, as shown in FIG. 2, at the bottom of the bearing attachment portion 1D, an annular stepped portion 1E for positioning a main bearing 18 (described later) in an axial direction is provided to extend radially inwardly. Further, at the other axial open end of the casing 1, there is provided an annular groove 1F into which a protruded portion 11A of a motor case 11 which will be described later is freely received.

The fixed scroll 2 is provided at the open end of the scroll side cylindrical portion 1A of the casing 1, and the fixed scroll is generally constituted by a disk-like end plate 2A around an axis O1-O1, a spiral wrap portion 2B protruded from a front surface of the end plate 2A, and a cylindrical support portion 2C provided at an outer peripheral side and encircling the wrap portion 2B. The support portion 2C is secured to the open end of the scroll side cylindrical portion 1A by using a plurality of scroll attaching screws 3 (only one of them is shown), thereby closing the open end of the scroll side cylindrical portion 1A.

The orbiting scroll 4 is opposed to the fixed scroll 2 and provided within the casing 1, and the orbiting scroll 4 is generally constituted by a disk-like end plate 4A around an axis O2-O2, a spiral wrap portion 4B protruded from a front surface of the end plate 4A, and a connection portion 4C which is protruded from a rear surface of the end plate 4A and to which the driving bush 19 (described later) is connected via an orbit bearing 24.

Here, the axis O2-O2 as a central axis of the orbiting scroll 4 is eccentric radially with respect to the axis O1-O1 as a central axis of the fixed scroll 2 by a predetermined eccentric amount δ defined by the driving bush 19. Further, the wrap portion 4B is disposed in an overlapped relationship with the wrap portion 2B of the fixed scroll 2 so that a plurality of compression chambers 5 is defined between the wrap portions 2B and 4B.

The orbiting scroll 4 is driven by the motor 9 (described later) via the rotary shaft 16 and driving bush 19 to perform an orbiting motion with respect to the fixed scroll 2. This orbiting motion is performed around the axis O1-O1 of the fixed scroll 2 with an orbiting radius substantially the same as the eccentric amount δ.

As a result, in the compressor, air is drawn into the outermost compression chamber 5 through an intake port 6 formed in the fixed scroll 2, and, when the orbiting scroll 4 performs an orbiting motion, the air is compressed and the compressed air reaching the innermost compression chamber 5 is discharged outside through a discharge port 7 formed in the fixed scroll 2.

In this case, plural (for example, three) rotation preventing mechanisms 8 (only one of them is shown) are provided between a rear surface of the orbiting scroll 4 and the partition wall portion 1C of the casing 1. These rotation preventing mechanisms 8 are designed to prevent rotation of the orbiting scroll 4 while permitting the orbiting motion of the orbiting scroll 4.

The motor 9 is an electric motor providing a drive source of the compressor and is generally constituted by an output shaft 10 having a male threaded one end portion 10B followed by a conical shaft portion 10A, a motor case 11 formed, for example, as a cylindrical shape having an open end on one axial side and a closed end on the other axial side (having a bottom) to cover the output shaft 10 from the other axial side, a motor bearing 12 provided at the bottom of the motor case 11, a rotor 13 provided on an axial intermediate portion of the output shaft 10, and a stator 14 provided on an inner peripheral surface of the motor case 11 and comprising a magnet and the like.

The male threaded portion 10B of the output shaft 10 is rotatably supported by a main bearing 18 via the rotary shaft 16. Further, the other end of the output shaft 10 is loosely received (loosely fitted) in the motor bearing 12, for example, and, thus, is rotatably supported by the motor bearing 12. With this arrangement, when the motor 9 is energized, the output shaft 10 is rotated about the axis O1-O1 to impart the orbiting motion to the orbiting scroll 4 via the rotary shaft 16 and driving bush 19.

On the other hand, the open end portion of the motor case 11 is provided with an annular protruded portion 11A protruding axially toward the casing 1, a flange portion 11B which abuts against the open end (end face) of the motor side cylindrical portion 1B of the casing 1, and a plurality of elongated holes 11C formed in the flange portion 11B and extending in a radial direction of the motor case 11.

The motor case 11 is attached to the end face of the motor side cylindrical portion 1B of the casing 1 by a plurality of motor attachment screws 15 inserted into the respective elongated holes 11C, in a condition that the protruded portion 11A is loosely fitted into the annular groove 1F of the casing 1 with a predetermined gap therebetween. In this condition, the attachment position of the motor case 11 can be adjusted along a radial direction of the output shaft 10 within a range of the length of the elongated hole 11C. Further, within the open end portion of the motor case 11, an annular plate 11D is positioned and secured at a position to close the open end of the motor side cylindrical portion 1B.

Next, a connecting structure between the orbiting scroll 4 and the motor 9 will be described. The rotary shaft 16 is attached to the output shaft 10 of the motor 9 by means such as screw connection. The rotary shaft 16 is rotatingly driven by output shaft 10 about the axis O1-O1 and serves to transmit the rotation of the motor 9 to the driving bush 19.

Here, as shown in FIG. 2, the rotary shaft 16 is formed as a cylindrical configuration centered on the axis O1-O1 and is formed from a sintered metal part integrally formed with a sub weight 17 which will be described later. Further, the rotary shaft 16 is loosely received (loosely fitted) in the main bearing 18 for example, so that the rotary shaft is rotatably supported by the main bearing 18.

Further, an axial one end (leading end) of the rotary shaft 16 is protruded from the main bearing 18 toward the driving bush 19. The protruded end of the rotary shaft is fitted into an shaft hole 19A of the driving bush 19 and is held in the shaft hole 19A by a washer 21 and an attachment screw 23 (both described later) to prevent the protruded end from being dislodged from the shaft hole.

Further, the rotary shaft 16 is provided with a tapered hole 16A opened at the motor side end face and having an inner diameter conically reduced toward the driving bush 19, and a motor side threaded hole 16B communicated with the reduced end of the tapered hole 16A and arranged in coaxial with the tapered hole 16A on the axis O1-O1. The conical shaft portion 10A of the output shaft 10 of the motor 9 is fitted into the tapered hole 16A, and the male threaded portion 10B of the output shaft 10 is screwed into the motor side threaded hole 16B.

Further, the rotary shaft 16 is provided at the driving bush side end face with a bush side threaded hole 16C which is opened toward the driving bush 19 and into which the attachment screw 23 (described later) is screwed. The bush side threaded hole 16C is centered on the axis O2-O2, and is opened in an axial direction opposite to the opening of the motor side threaded hole 16B, and is eccentric from the motor side threaded hole 16B by the eccentric amount δ.

On the other hand, as shown in FIG. 2, the rotary shaft 16 is provided at its outer periphery with an annular stepped portion 16D positioned at the end near the sub weight 17 and protruded radially outwardly, and an inner race 18B of the main bearing 18 is seated in the stepped portion 16D.

The sub weight 17 is integrally formed with the outer periphery of the rotary shaft 16, for example, and has a center of gravity thereof located at a position eccentric radially from the axis O1-O1. The sub weight 17 is designed so that, for example, when the counter weight 20 (described later) and the orbiting scroll 4 are rotated with opposite phrases (180° deviated positions), the sub weight is rotated with the same phase as the orbiting scroll 4, thereby achieving weight balance between the counter weight and the orbiting scroll.

In this case, the sub weight 17 is designed so that, when centrifugal forces applied to the orbiting scroll 4 and the counter weight 20 act as an external force (moment force) tending to tilt the driving bush 19 and the like with respect to the axis O1-O1, the sub weight can cancel such a moment force.

Figure 5:
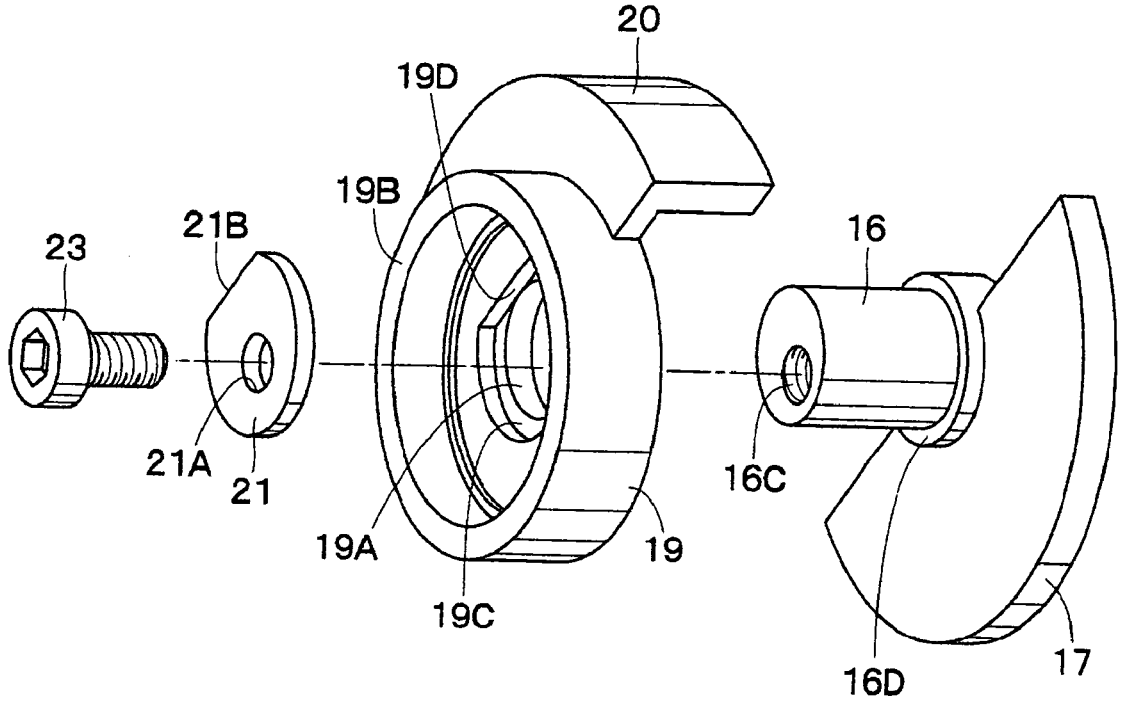
FIG. 5 is an exploded perspective view showing the rotary shaft, the driving bush, the washer, an attachment bolt and the like in a disassembled condition.

Further, as shown in FIG. 5, for example, the sub weight 17 is formed as a substantially arc-shaped (fan-shaped) plate member and is protruded radially outwardly from the rotary shaft 16. Further, the sub weight 17 is disposed between the partition wall portion 1C of the casing 1 and the motor 9 and is housed within the motor side cylindrical portion 1B (refer to FIG. 1).

Further, for example, the sub weight 17 is eccentric in the same eccentric direction as that of the bush side threaded hole 16C with respect to the axis O1-O1 of the rotary shaft 16. In this case, a positional relationship between the bush side threaded hole 16C and the sub weight 17 in the eccentric direction was previously set or determined upon designing the compressor.

The main bearing 18 is provided within the bearing attachment portion 1D of the casing 1. As shown in FIG. 2, the main bearing 18 is constituted, for example, by combining two deep groove ball bearings or angular ball bearings and serves to rotatably support the rotary shaft 16 for a rotational movement around the axis O1-O1.

The main bearing 18 comprises an outer race 18A fitted (closely fitted) into the bearing attachment portion 1D of the casing 1 by press fit or the like, an inner race 18B disposed within the outer race 18A and loosely received (loosely fitted) on an outer periphery of the rotary shaft 16, and rolling members 18C comprising a plurality of steel balls for rotatably connecting the outer race 18A to the inner race 18B.

The main bearing 18 is positioned within the casing 1 in the axial direction by abutting an end face of the outer race 18A against the stepped portion 1E of the casing 1 and abutting an end face of the inner race 18B against a protruded portion 19E of the driving bush 19 thereby to pinch the main bearing between the stepped portion 1E and the protruded portion 19E. Further, the inner race 18B of the main bearing 18 is pinched between the stepped portion 16D of the rotary shaft 16 and the protruded portion 19E of the driving bush 19, with the result that the inner race is positioned in the axial direction with respect to the rotary shaft 16 and the driving bush 19.

The driving bush 19 is a substantially cylindrical bush provided at one axial end (leading end) of the rotary shaft 16. The driving bush 19 cooperates with the orbit bearing 24 (described later) to connect the connection portion 4C of the orbiting scroll 4 to the rotary shaft 16 so that, when the rotary shaft 16 is rotated, the orbiting scroll 4 performs an orbiting motion.

Here, as shown in FIGS. 2 to 5, the driving bush 19 is constituted by a sintered metal part integrally formed with the counter weight 20 (described later). Further, the driving bush 19 is attached to the leading end of the rotary shaft 16 by the washer 21 and attachment bolt 23 (both described later) so that the driving bush cannot be rotated with respect to the rotary shaft. In this case, the driving bush 19 is opposed to the sub weight 17 with the interposition of the main bearing 18 in the axial direction and serves to hold the main bearing 18 in the bearing attachment portion 1D of the casing 1 in such a manner that the main bearing cannot dislodge from the bearing attachment portion.

Further, the driving bush 19 includes the shaft hole 19A into which the leading end of the rotary shaft 16 is inserted, a cylindrical boss portion 19B which has a bottom and to which the connection portion 4C of the orbiting scroll 4 is attached via the orbit bearing 24, a washer attachment groove 19C which is positioned between the shaft hole 19A and the boss portion 19B and is disposed to encircle the shaft hole 19A and into which the washer 21 is fitted, a chamfered portion 19D as a straight non-circular section provided at a part of a peripheral wall of the washer attachment groove 19C, and the annular protruded portion 19E protruding axially toward the rotary shaft 16 at a position encircling the shaft hole 19A.

In this case, the shaft hole 19A is formed as a circular hole having the axis O1-O1 (center O1). The shaft hole 19A is opened to the end face of the driving bush 19 and the bottom of the boss portion 19B and is axially continuous to the boss portion 19B via an inner periphery of the washer attachment groove 19C. Further, the boss portion 19B is formed as a cylindrical configuration having the axis O2-O2 (center O2) and is opened to a side opposite to the shaft hole 19A in the axial direction and is eccentric radially from the center O1 of the shaft hole 19A by the eccentric amount δ.

Figure 4:
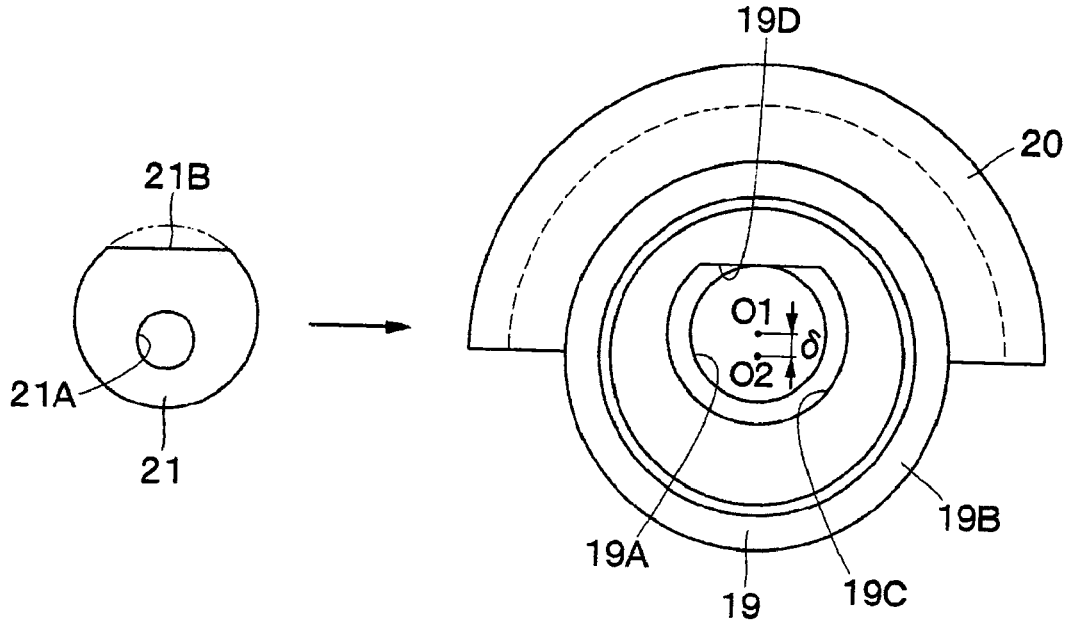

Further, the washer attachment groove 19C is formed as a substantially C-shaped concave groove having substantially the same configuration as the outer configuration of the washer 21 by enlarging the diameter of the open end of the shaft hole 19A opened to the bottom of the boss portion 19B and becomes non-circular at the position of the chamfered portion 19D, as shown in FIG. 4.

Further, an inner diameter size of the driving bush 19 is reduced step by step from the boss portion 19B to the shaft hole 19A; i.e. diameters of the boss portion 19B, washer attachment groove 19C and shaft hole 19A are reduced step by step. Thus, for example, when the shaft hole 19A, boss portion 19B and washer attachment groove 19C are cut by using a cutting tool such as a milling cutter, the cutting working can be performed smoothly by a continuous operation from the boss portion 19B.

The counter weight 20 is integrally formed with the outer periphery of the driving bush 19, for example. A center of gravity of the counter weight 20 is positioned on a radially opposite side of the center of the rotary shaft 16 from the center axis of the orbiting scroll 4. Thus, when the orbiting scroll 4 performs an orbiting motion, the counter weight 20 is, rotated with the opposite phase (180° deviated position) relative to the orbiting scroll 4, thereby canceling the centrifugal force of the orbiting scroll 4 acting on the driving bush 19.

As shown in FIG. 4, a position where the counter weight 20 is formed is set on a radially opposite side to the center O2 of the boss portion 19B (180° deviated position) with the interposition of the center O1 of the shaft hole 19A, so that the positional relationship between the orbiting scroll 4 and the counter weight 20 has the opposite phase.

Further, as shown in FIG. 5, for example, the counter weight 20 is formed as an arc-shaped (fan-shaped) plate member and is protruded radially outwardly from the driving bush 19 at a side of the main bearing 18 remote from the motor 9. Further, a radial outer periphery of the counter weight 20 is bent as a substantially L-shaped configuration extending in the axial direction to surround the bearing attachment portion 1D from the outside.

The washer 21 is a substantially circular plate provided between the rotary shaft 16 and the driving bush 19. The washer 21 is fitted into the washer attachment groove 19C of the driving bush 19 and is secured to the leading end of the rotary shaft 16 by the attachment bolt 23 (described later). As shown in FIG. 4, the washer 21 is provided with a bolt receiving hole 21A through which a cylindrical portion 23A of the attachment bolt 23 is inserted, and a straight non-circular chamfered portion or cutout portion 21B formed on a portion of an outer periphery of the washer 21.

Further, the outer periphery of the washer 21 other than the chamfered portion 21B is formed as a circle, and the bolt receiving hole 21A is eccentric radially from the center of the circle by the eccentric amount δ corresponding to the eccentric amount of the orbiting scroll 4. Further, the chamfered portion 21B of the washer 21 cooperates with the chamfered portion 19D of the driving bush 19 to form an engagement portion 22 which will be described later.

The engagement portion 22 is provided between the driving bush 19 and the washer 21. The engagement portion 22 is constituted by the chamfered portion 19D of the driving bush 19 and the chamfered portion 21B of the washer 21 so that, when the chamfered portions 19D and 21B are engaged by each other, a relative rotation between the driving bush 19 and the washer 21 is prevented.

In this case, since the washer 21 is tightened to the rotary shaft 16 by the attachment bolt 23 at a position eccentric radially from the axis O1-O1, by cooperating with the engagement portion 22, the washer can prevent a relative rotation between the rotary shaft 16 and the driving bush 19.

The attachment bolt 23 is associated with the rotary shaft 16 and the driving bush 19. For example, the attachment bolt 23 is constituted by a hexagon socket head cap screw, and is inserted into the bolt receiving hole 21A of the washer 21 and screwed into the bush side threaded hole 16C of the rotary shaft 16 through the washer 21.

The attachment bolt 23 cooperates with the washer 21 to secure the driving bush 19 to the leading end of the rotary shaft 16. In this condition, for example, five parts including the casing 1, rotary shaft 16, main bearing 18, driving bush 19 and washer 21 are held between the attachment bolt 23 and the sub weight 17 in such a manner that these parts cannot be dislodged.

Thus, upon assembling the compressor, by attaching the attachment bolt 23 after these five parts were combined in a predetermined order, plural parts including the casing 1, rotary shaft 16, sub weight 17, main bearing 18, driving bush 19, counter weight 20, washer 21 and the like can easily be integrated, thereby enhancing an assembling efficiency.

Further, in this assembling operation, when the attachment bolt 23 is attached, the bush side threaded hole 16C of the rotary shaft 16 and the bolt receiving hole 21A of the washer 21 are aligned with each other in the axial direction. To this end, a positional relationship between the sub weight 17 and the counter weight 20 is previously set so that these weights have opposite phases with each other with respect to a common reference position defined by the bush side threaded hole 16C and the bolt receiving hole 21A Further, for example, the attachment bolt 23 is constituted by a high accuracy bolt element such as a pin bolt, and a section of the bolt to be inserted into the bolt receiving hole 21A is formed as the cylindrical portion 23A having an accurate circular configuration in section. In this way, any play between the rotary shaft 16 and the driving bush 19 along the rotational direction can be prevented.

On the other hand, the orbit bearing 24 serves to rotatably support the orbiting scroll 4. For example, the orbit bearing 24 is constituted by an outer race 24A loosely fitted into the boss portion 19B of the driving bush 19, an inner race 24B fitted onto the outer periphery of the connection portion 4C of the orbiting scroll 4 within the outer race 24A, and a plurality of rolling members 24C such as steel balls for rotatably connecting the outer race 24A and the inner race 24B.

The scroll type air compressor according to this embodiment has the above-mentioned construction. Next, the assembling operation of the compressor will be described.

Figure 3:
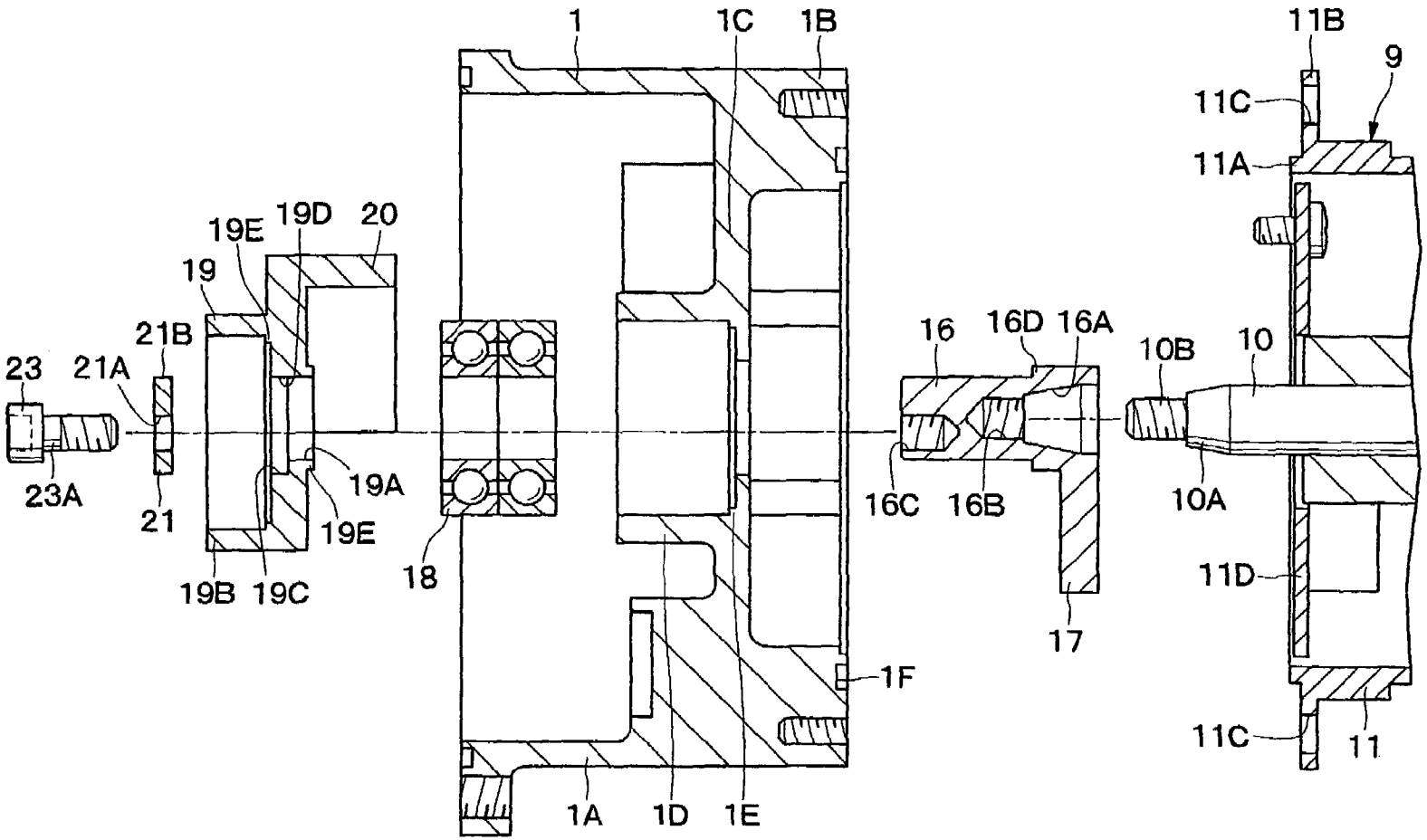

In this assembling operation, first of all, the main bearing 18 is attached into the bearing attachment portion 1D of the casing 1 shown in FIG. 3. Then, the rotary shaft 16 is inserted into the main bearing 18 through the motor side cylindrical portion 1B of the casing 1 in such a manner that the leading end of the rotary shaft 16 is protruded from the main bearing 18 toward the scroll side cylindrical portion 1A of the casing 1.

Then, the driving bush 19 and the washer 21 are assembled to the protruded leading end of the rotary shaft 16 protruded from the main bearing 18. Then, in a condition that the bush side threaded hole 16C of the rotary shaft 16 and the bolt receiving hole 21A of the washer 21 are aligned with each other, the attachment bolt 23 is attached through these holes.

As a result, eight parts including the casing 1, rotary shaft 16, sub weight 17, main bearing 18, driving bush 19, counter weight 20, washer 21 and attachment bolt 23 are assembled. Then, by assembling the orbit bearing 24, rotation preventing mechanism 8, orbiting scroll 4 and fixed scroll 2, main portions other than the motor 9 can be assembled.

Then, when the motor 9 is assembled or attached, first of all, the output shaft 10 is removed from the motor case 11 and then the male threaded portion 10B of the output shaft 10 is screwed into the motor side threaded hole 16B of the rotary shaft 16. In this case, for example, the motor 9 is constituted by one sub-assembly including the output shaft 10, rotor 13 and the like and another sub-assembly including the motor case 11, motor bearing 12, stator 14 and the like.

Then by mounting the motor case 11 from the other side in axial direction of the output shaft 10, the other end of the output shaft 10 is inserted into the motor bearing 12. Then, the flange portion 11B of the motor case 11 is engaged by the open end Of the motor side cylindrical portion 1B of the casing 1 and the protruded portion 11A is loosely fitted into the annular groove 1F of the casing 1.

Further, in a condition that the radial position of the motor case 11 is properly adjusted with respect to the casing 1, the plural motor attachment screws 15 are inserted into the respective elongated holes 11C of the motor case 11 and are screwed into the casing 1 through these elongated holes 11C. In this way, the motor 9 can be attached, thereby completing the compressor.

Next, an operation of the scroll type air compressor will be explained. When the motor 9 is energized, the rotary shaft 16 and the driving bush 19 are rotatingly driven around the axis O1-O1 by the output shaft 10 of the motor.

As a result, the boss portion 19B of the driving bush 19 is rotated around the axis O1-O1 with the radial eccentric amount δ. The orbiting scroll 4 attached to the boss portion 19B via the orbit bearing 24 performs an orbiting motion with the orbiting radius corresponding to the eccentric amount δ in the condition that the rotation of the orbiting scroll itself is prevented by the rotation preventing mechanisms 8.

As a result, the compression chambers 5 defined between the wrap portion 2B of the fixed scroll 2 and the wrap portion 4B of the orbiting scroll 4 are continuously reduced from the outer diameter side to the inner diameter side. Thus, in the compressor, the airs drawn into the respective compression chambers 5 through the intake port 6 are successively compressed, and the compressed air is discharged outside through the discharge port 7.

In this case, since the counter weight 20 is rotated with the opposite phase relative to the orbiting scroll 4, the centrifugal force of the orbiting scroll 4 acting on the driving bush 19 and the like can be canceled. Further, since the sub weight 17 and the orbiting scroll 4 are positioned on both axial sides of the counter weight 20, respectively, and the sub weight is rotated with the same phase as the orbiting scroll 4 at this position, the radial moment force applied to the driving bush 19 from the orbiting scroll 4 and the counter weight 20 can be canceled.

As such, according to this embodiment, the compressor includes the rotary shaft 16 having the sub weight 17, the driving bush 19 having the counter weight 20, and the attachment bolt 23 for attaching the driving bush 19 to the rotary shaft 16.

Thus, during the assembling operation of the compressor, by the attaching operation of the attachment bolt 23, not only the rotary shaft 16, sub weight 17, driving bush 19 and counter weight 20, but also the main bearing 18, casing 1 and the like can be integrated. Accordingly, the assembling of these parts can be simplified and plural parts can be assembled efficiently.

Further, by merely assembling the rotary shaft 16 and the driving bush 19 with each other, the positional relationship between the orbiting scroll 4 and the counter weight 20 and the sub weight 17 in the rotational direction can be aligned accurately. Thus, during the assembling of the compressor, for example, since it is not necessary that the positional relationships between these parts be set or adjusted by using tools such as positioning keys, pins or the like, excessive operations or steps can be removed, thereby enhancing the working efficiency.

Further, also before the motor 9 is assembled, the weight balance in the rotational direction can be determined at the time when the orbiting scroll 4, rotary shaft 16, driving bush 19 and the like are assembled. Accordingly, for example, since it is not necessary that other weight member be provided at the side of the motor 9 and a position of such member be adjusted, the assembling operation can be simplified and productivity can be enhanced.

In addition, for example, since the rotary shaft 16 and the sub weight 17 are integrally formed with each other and the driving bush 19 and the counter weight 20 are integrally formed with each other, these parts can be worked and formed easily and the number of parts can be reduced, thereby suppressing costs.

Further, since the engagement portion 22 is provided between the driving bush 19 and the washer 21 to prevent the relative rotation therebetween and the washer 21 is attached to the rotary shaft 16 by the attachment bolt 23 with the eccentric condition, the relative rotation between the rotary shaft 16 and the driving bush 19 can be prevented.

With this arrangement, for example, by using the bush side threaded hole 16C of the rotary shaft 16 and the bolt receiving hole 21A of the washer 21 as the common reference position, the positioning of the orbiting scroll 4, counter weight 20 and sub weight 17 can easily performed with a simple construction.

Further, a section of the driving bush 19 located between the shaft hole 19A and the boss portion 19B can be formed as a separate part (washer 21). In this case, when the driving bush 19 is worked, since the shaft hole 19A, boss portion 19B and washer attachment groove 19C can be worked efficiently by a series of processes and, for example, it is not necessary that orientation of the driving bush 19 be changed during the working operation, the driving bush 19 can easily be formed.

Figure 6:
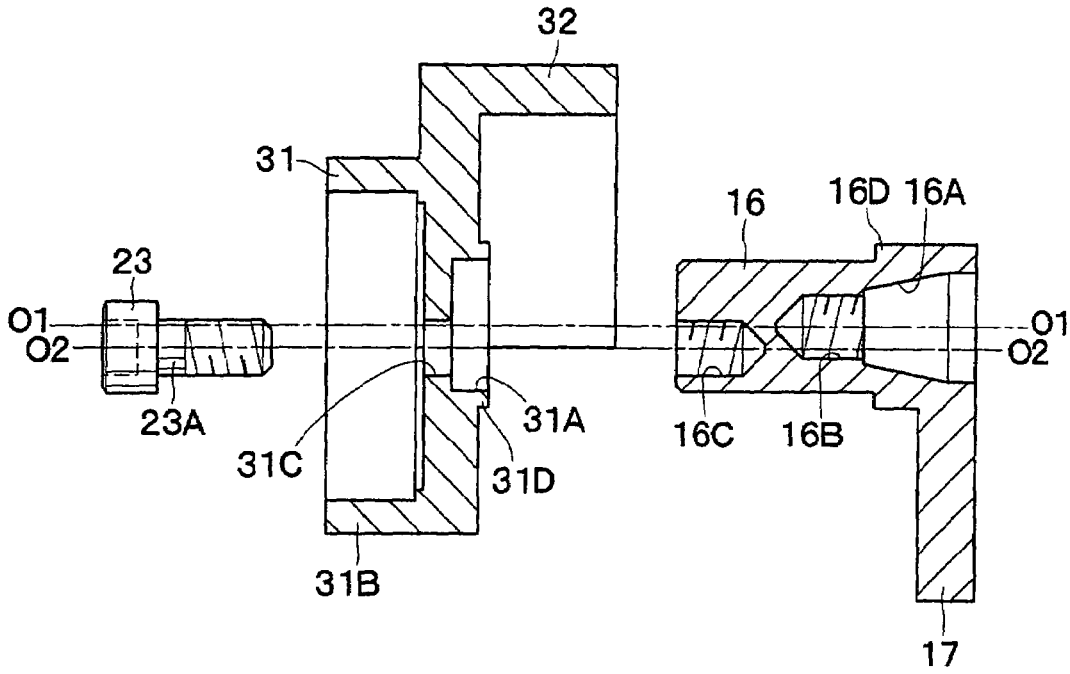
FIG. 6 is a longitudinal sectional view showing a rotary shaft, a driving bush and the like of a scroll type air compressor according to a second embodiment of the present invention.
Figure 7:
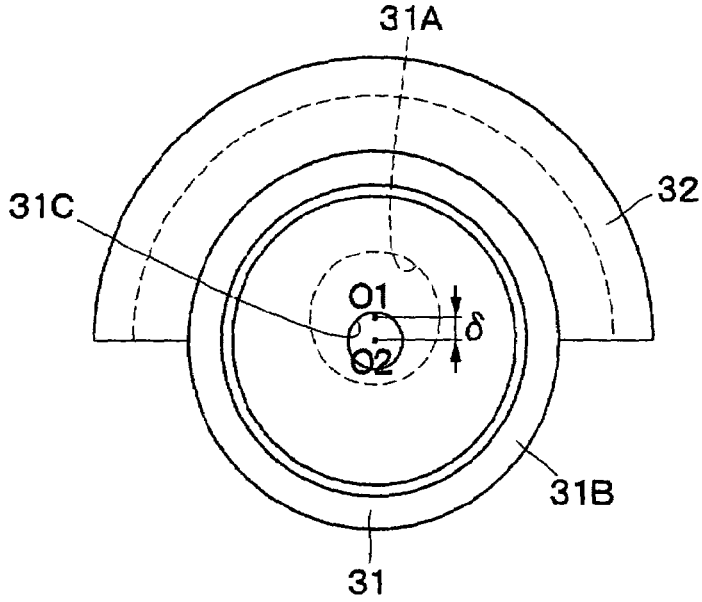
FIG. 7 is a front view showing the driving bush and a counter weight.

FIGS. 6 and 7 show a second embodiment of the present invention. The second embodiment is characterized in that a washer can be eliminated. Incidentally, in the second embodiment, the same constructional elements as those in the first embodiment are designated by the same reference numerals and explanation thereof will be omitted.

A driving bush 31 is provided at a leading end side of the rotary shaft 16. Substantially similar to the first embodiment, the driving bush 31 includes an shaft hole 31A centered on the axis O1-O1, a cylindrical boss portion 31B centered on the axis O2-O2 and having a bottom, and an annular protruded portion 31D and is formed integrally with a counter weight 32.

However, the driving bush 31 is constructed by integrally forming the driving bush 19 and washer 21 of the first embodiment with each other. The boss portion 31B is provided at its bottom with a bolt receiving hole 31C substantially similar to that of the washer 21 and, as shown in FIG. 7, the bolt receiving hole 31C is formed as a circle having the axis O2-O2 (center O2).

In this arrangement, the attachment bolt 23 is screwed into the bush side threaded hole 16C of the rotary shaft 16 through the bolt receiving hole 31C of the driving bush 31, thereby connecting the driving bush 31 to the rotary shaft 16.

In this way, also in the second embodiment having the above-mentioned construction, technical effects substantially the same as those of the first embodiment can be achieved. Particularly, in the second embodiment, since the driving bush 31 to which the washer is integrated is used, the number of parts of the compressor can be reduced and the forming and assembling operations of the parts can be performed efficiently.

Figure 8:
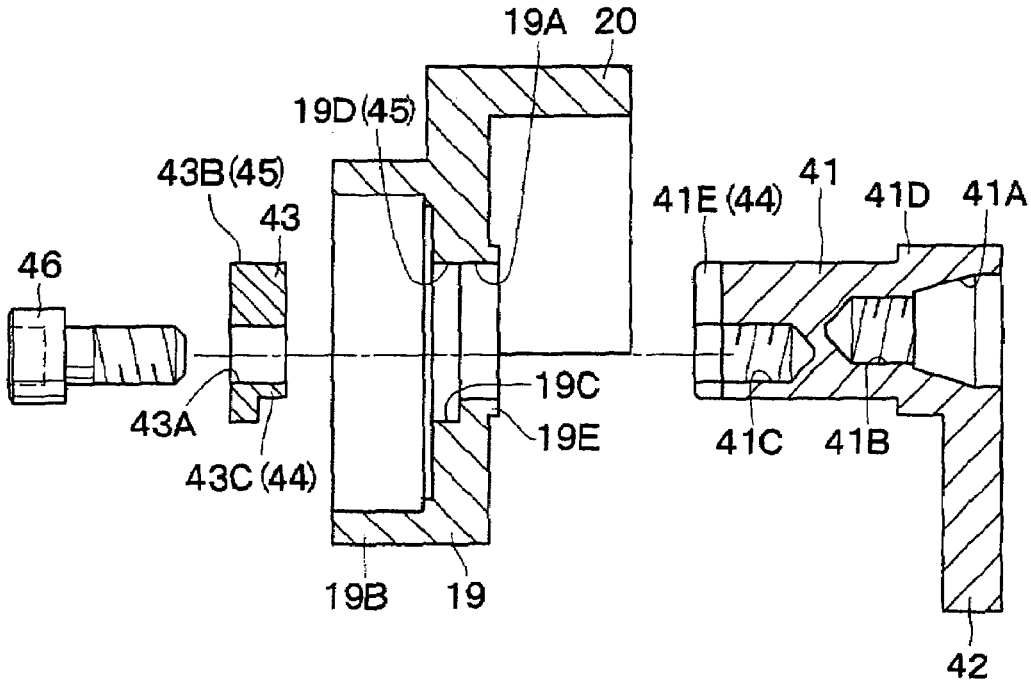
FIG. 8 is a longitudinal sectional view showing a rotary shaft, a driving bush, a washer and the like of a scroll type air compressor according to a third embodiment of the present invention.
Figure 9:
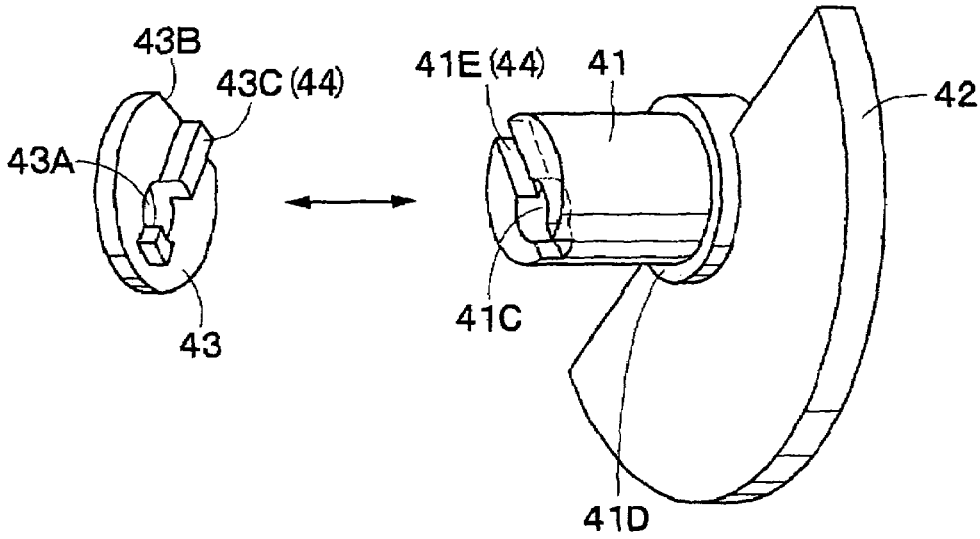

FIGS. 8 and 9 show a third embodiment of the present invention. The third embodiment is characterized in that an engagement portion is provided between a rotary shaft and a washer. Incidentally, in the third embodiment, the same constructional elements as those in the first embodiment are designated by the same reference numerals and explanation thereof will be omitted.

A rotary shaft 41 is connected to the driving bush 19. Substantially similar to the first embodiment, the rotary shaft 41 includes a tapered hole 41A, a motor side threaded hole 41B, a bush side threaded hole 41C, a stepped portion 41D and the like and is formed integrally with a sub weight 42. However, as shown in FIG. 9, for example, an engagement groove 41E extending in a diametrical direction of the rotary shaft 41 across the bush side threaded hole 41C is formed in a leading end of the rotary shaft 41.

A washer 43 is fitted into the washer attachment groove 19C of the driving bush 19. Substantially similar to the first embodiment, the washer 43 includes a circular bolt receiving hole 43A and a straight chamfered portion 43B. Further, the washer 43 is provided with an elongated protrusion 43C which is opposed to the end face of the leading end of the rotary shaft 41 and which extends in a diametrical direction of the washer 43.

An engagement portion 45 is provided between the driving bush 19 and the washer 43. Substantially similar to the first embodiment, the engagement portion 45 is constituted by the chamfered portion 19D of the driving bush 19 and the chamfered portion 43B of the washer 43. The chamfered portions 19D and 43B can engage with each other to prevent a relative rotation between the driving bush 19 and the washer 43.

Another engagement portion 44 is provided between the rotary shaft 41 and the washer 43. The engagement portion 44 is constituted by the engagement groove 41E of the rotary shaft 41 and the protrusion 43C of the washer 43. When the washer 43 is fitted into the washer attachment groove 19C of the driving bush 19, the protrusion 43C protrudes axially from the washer attachment groove 19C toward the shaft hole 19A and is engaged by the engagement groove 41E of the rotary shaft 41.

In this way, the engagement portion 44 serves to prevent a relative rotation between the rotary shaft 41 and the washer 43. As a result, the rotary shaft 41 and the driving bush 19 are positioned relative to each other in the rotational direction by means of two engagement portions 44 and 45, so that the rotary shaft and the driving bush can be rotated integrally.

Substantially similar to the first embodiment, an attachment bolt 46 is tightened to the rotary shaft 41 through the washer 43. However, the attachment bolt 46 is constituted by a general purpose bolt element having normal part accuracy, rather than a bolt element having high accuracy such as a pin bolt.

In this way, also in the third embodiment having the above-mentioned construction, technical effects substantially the same as those of the first embodiment can be achieved. Particularly, in the third embodiment, the engagement portion 45 is provided between the driving bush 19 and the washer 43 and another engagement portion 44 is provided between the rotary shaft 41 and the washer 43. With this arrangement, by using two engagement portions 44 and 45, the relative rotation between the rotary shaft 41 and the driving bush 19 can be prevented.

In this case, since the relative rotation between the rotary shaft 41 and the washer 43 can be prevented by the engagement portion 44, for example, even if the bolt element having high accuracy such as the pin bolt is not used as the attachment bolt 46, the rotary shaft 41 and the washer 43 can be accurately positioned with each other in the rotational direction, so that any play between these elements can be eliminated, thereby suppressing the cost of the parts.

Figure 10:
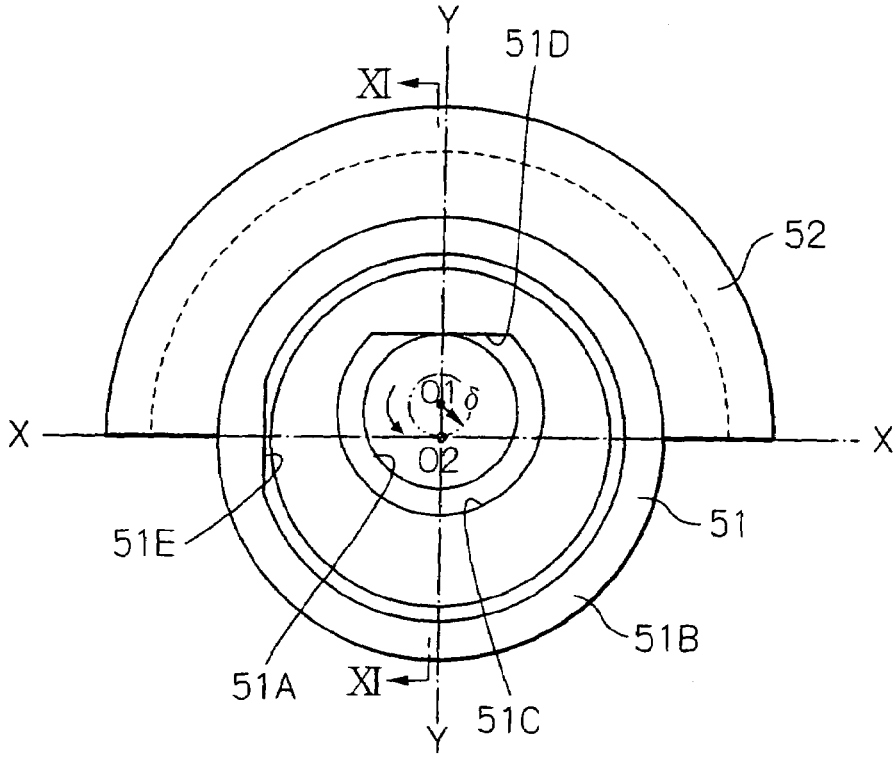
FIG. 10 is a front view showing a driving bush and the like of a scroll type air compressor according to a fourth embodiment of the present invention.
Figure 11:
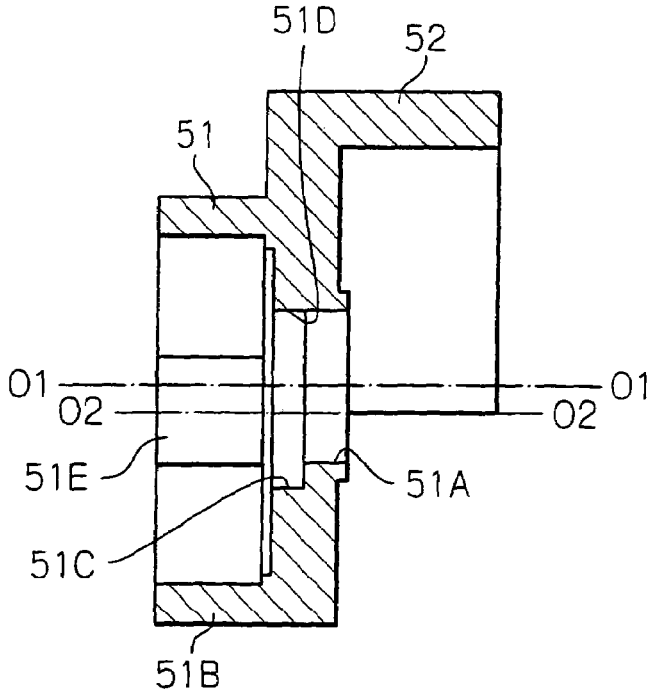
FIG. 11 is a longitudinal sectional view of the driving bush, a counter weight and the like, looked at from a direction shown by the arrows XI-XI in FIG. 10.
Figure 12:
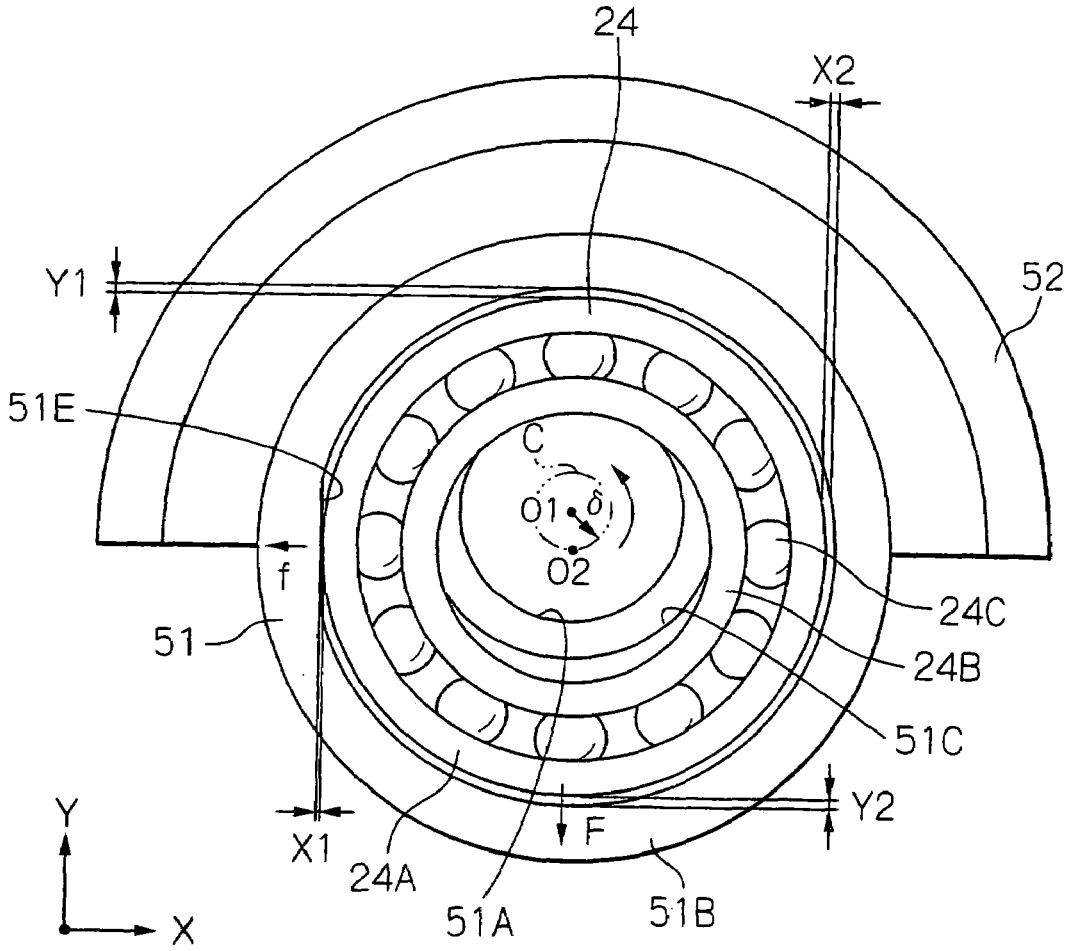
FIG. 12 is an explanatory view showing a condition that an orbit bearing is fitted into a boss portion of the driving bush.

FIGS. 10 to 12 show a fourth embodiment of the resent invention. The fourth embodiment is characterized in that a straight portion is provided in a boss portion of a driving bush. Incidentally, in the fourth embodiment, the same constructional elements as those in the first embodiment are designated by the same reference numerals and explanation thereof will be omitted.

Substantially similar to the first embodiment, a driving bush 51 includes a shaft hole 51A centered on the axis O1-O1, a cylindrical boss portion 51B centered on the axis O2-O2 and having a bottom, a washer attachment groove 51C and a chamfered portion 51D, and is formed integrally with a counter weight 52.

However, for example a single straight portion 51E is formed on an inner periphery of the boss portion 51B. In this case, the inner periphery of the boss portion 51B formed as a concave circular surface, except for the straight portion 51E, and the straight portion 51E is formed as a flat surface protruded radially inwardly from the concave circular surface.

Further, the straight portion 51E is formed in parallel with a diametrical straight line (for example, shown as Y axis) connecting between the center O1 of the shaft hole 51A and the center O2 of the boss portion 51B. Further, the straight portion 51E is located to cross a diametrical straight line (for example, shown as X axis) passing through the center O2 of the boss portion 51B and perpendicular to the Y axis and extends on both sides of the X axis along the Y axis direction.

In this case, if the center O2 of the orbiting scroll (not shown) orbits along an orbit track C, the X axis is defined as an axis representing a tangential line (referred to as "movement direction of the orbiting scroll" hereinafter) on the orbit track C at the center O2 of the orbiting scroll. Further, the Y axis is defined as a line representing a direction (referred to as "eccentric direction of the orbiting scroll" hereinafter) in which the center O2 of the orbiting scroll is eccentric from the orbit center (center O1) at any time.

When the compressor is being operated, the straight portion 51E permits that the orbit bearing 24 fitted in the boss portion 51B is displaced in the Y axis direction (eccentric direction of the orbiting scroll) along the straight portion 51E and prevents that the orbit bearing 24 is displaced in the X axis direction (movement direction of the orbiting scroll).

Here, explaining dimensional relationship between the orbit bearing 24 and the boss portion 51B, as shown in FIG. 12, the outer race 24A of the orbit bearing 24 is loosely fitted into the boss portion 51B in consideration of the operability during the assembling operation so that a minute gap or clearance which does not affect an influence upon the compressing operation is formed between the outer race and the boss portion. Incidentally, in FIG. 12, a radial dimension of such a clearance exaggeratedly shown.

In this case, for example, when it is assumed that a radial clearance between the orbit bearing 24 and the straight portion 51E of the boss portion 51B is (X1 +X2) and a radial clearance between the orbit bearing and the straight portion of the boss portion at positions other than the straight portion 51E is (Y1 +Y2), the clearance (X1 +X2) in the X axis direction becomes smaller than the clearance (Y1 +Y2) in the Y axis direction by the existence of the straight portion 51E. That is to say:

$$(X1+X2)<(Y1+Y2)$$

Thus, the orbit bearing 24 can almost not be displaced in the X axis direction within the boss portion 51B, but can be displaced slightly in the Y axis direction.

Next, explaining a function of the straight portion 51E, when the compressor is being operated, the straight portion 51E is rotated around the center O1 with a radius of the eccentric amount δ while urging and pushing the orbiting scroll, with the result that the orbiting scroll performs an orbit motion. In this case, the centrifugal force F acting on the orbiting scroll in the Y axis direction is also applied to the orbit bearing 24 from the orbiting scroll.

Further, for example, a reaction force generated when the orbiting scroll is urged and gas pressure generated when the orbiting scroll compresses the air are also applied to the orbit bearing 24 as a reaction force f in the X axis direction. Thus, in a condition that the orbit bearing 24 is urged against the straight portion 51E of the boss portion 51B by the reaction force f in the X axis direction, the orbit bearing 24 also undergoes the centrifugal force F in the Y axis direction.

In this case, since the straight portion 51E extends flatly along the Y axis direction, even under the condition that the orbit bearing 24 is urged against the straight portion 51E by the reaction force f, the orbit bearing can be slidingly displaced in the Y axis direction along the straight portion 51E by the centrifugal force F, and, thus, the orbit bearing can be displaced smoothly in the Y axis direction together with the orbiting scroll.

As a result, when the orbiting scroll is displaced with respect to the fixed scroll in the Y axis direction (eccentric direction of the orbiting scroll), the wrap portion of the orbiting scroll approaches the wrap portion of the fixed scroll adequately, thereby reducing the radial gap or clearance between the wrap portions. In this way, air-tightness of the compression chambers defined between the wrap portions can be enhanced.

Further, when the orbiting scroll performs an orbiting motion, displacement of the orbit bearing 24 in the X axis direction (movement direction of the orbiting scroll) is prevented by the straight portion 51E of the boss portion 51B.

Thus, the orbit bearing 24 can be prevented from being shaken within the boss portion 51B in the movement direction, thereby achieving the stable orbiting motion.

In this way, also in the fourth embodiment having the above-mentioned construction, technical effects substantially the same as those of the first embodiment can be achieved. Particularly, in the fourth embodiment, since the straight portion 51E is provided on the inner periphery of the boss portion 51B of the driving bush 51, the straight portion 51E can be extended along the eccentric direction of the orbiting scroll.

With this arrangement, during the operation of the compressor, the orbit bearing 24 fitted in the boss portion 51B can be displaced smoothly along the straight portion 51E toward the eccentric direction of the orbiting scroll, and, in this case, the orbiting scroll can also be displaced toward the eccentric direction together with the orbit bearing. As a result, the radial clearance defined between the wrap portion of the orbiting scroll and the wrap portion of the fixed scroll can be reduced. Thus, the air-tightness of the compression chambers defined between the wrap portions can be enhanced, thereby increasing the compressing ability.

Further, the straight portion 51E of the boss portion 51B can prevent the orbit bearing 24 from being displaced toward the direction perpendicular to the eccentric direction, i.e. toward the movement direction of the orbiting scroll. In this way, the orbit bearing 24 can be prevented from being displaced toward undesirable directions and shaken, with the result that the orbiting scroll performs an orbit motion stably.

Figure 13:
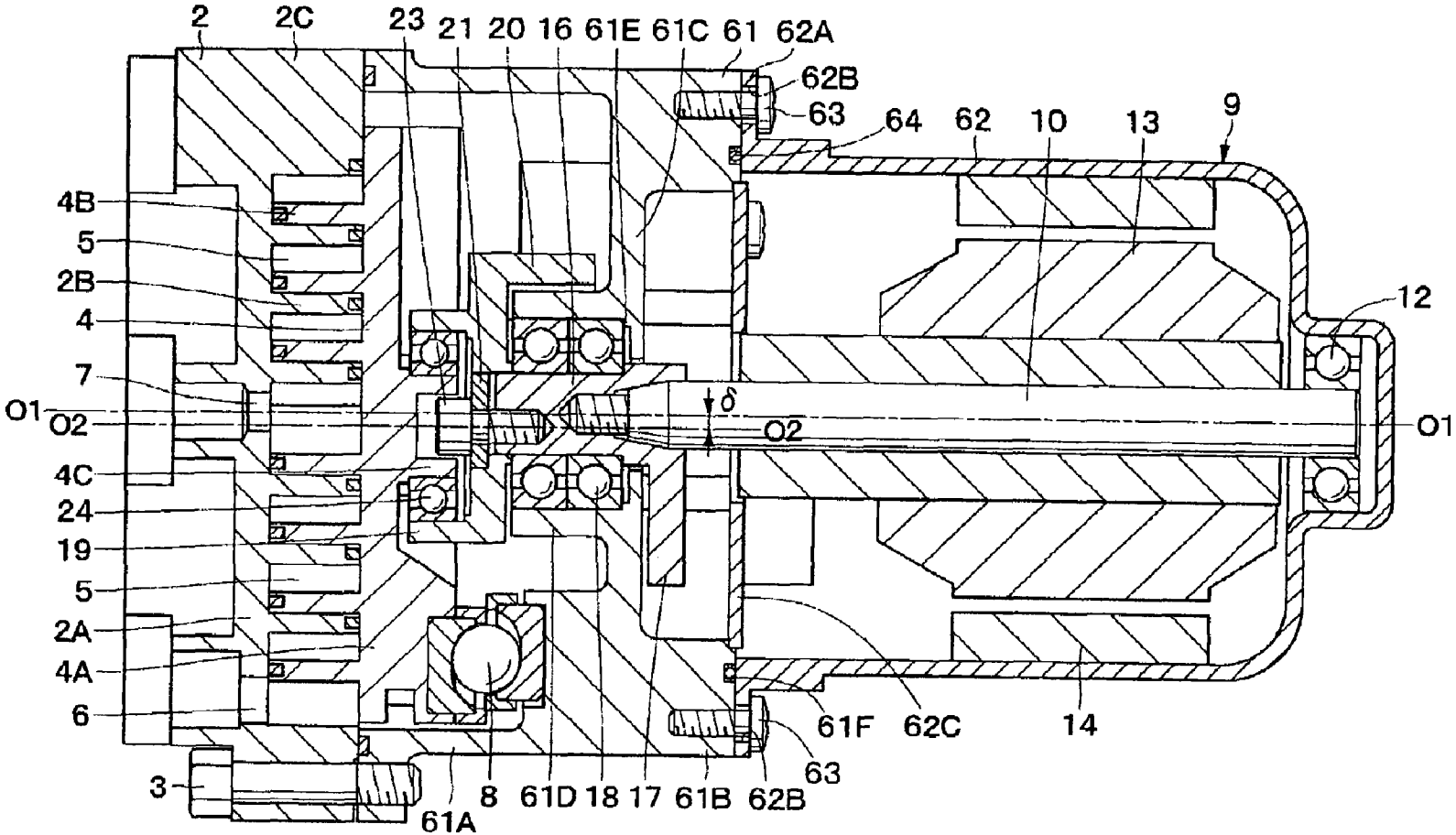
FIG. 13 is a longitudinal sectional view showing a scroll type air compressor according to a fifth embodiment of the present invention.

FIG. 13 shows a fifth embodiment of the present invention. The fifth embodiment is characterized in that an attaching structure between the casing and the drive source is simplified. Incidentally, in the fifth embodiment, the same constructional elements as those in the first embodiment are designated by the same reference numerals and explanation thereof will be omitted.

A casing 61 constitutes an outer shell of the compressor. Substantially similar to the first embodiment, the casing 61 includes a large diameter portion 61A, a small diameter portion 61B, a partition wall portion 61C, a bearing attachment portion 61D, a stepped portion 61E, an annular groove 61F and the like. However, the annular groove 61F is formed as a seal mounting concave groove.

A motor case 62 constitutes an outer shell of the motor 9. Substantially similar to the first embodiment, for example, the motor case 62 is formed as a cylindrical configuration having a bottom and opened at its one axial end and includes a flange portion 62A, elongated holes 62B and an annular plate 62C. However, the protruded portion 11A of the first embodiment is omitted from the motor case 62.

In a condition that the flange portion 62A abuts against an open end of the small diameter portion 61B of the casing 61, the motor case 62 is attached to the end face of the small diameter portion 61B of the casing 61 by means of a plurality of motor attachment screws 63 inserted into the elongated holes 62B. In this condition, a seal ring 64 for sealing the interface between the casing and the motor case 62 is provided in the annular groove 61F of the casing 61.

In this way, also in the fifth embodiment having the above-mentioned construction, technical effects substantially the same as those of the first embodiment can be achieved. Particularly, in the fifth embodiment, the configuration of the motor case 62 and the attaching structure between the motor case and the casing 61 can be simplified.

Incidentally, in the above-mentioned embodiments, while an example that the sub weight 17 (42) is integrally formed with the rotary shaft 16 (41) and the counter weight 20 (32, 52) is integrally formed with the driving bush 19 (31, 51) was explained, the present invention is not limited to this example, but, for example, the rotary shaft and the sub weight may be previously formed as separate parts, and, after these parts are integrated with each other, the assembling operation of the compressor may be performed. Further, similar to this, the driving bush and the counter weight may be previously formed as separate parts, and then, these parts may be integrated with each other.

Further, in the above-mentioned embodiments, an example that the straight chamfered portions 19D, 21B (51D, 43B) are provided on the washer attachment groove 19C (51C) of the driving bush 19 (51) and on the outer periphery of the washer 21 (43) and the engagement portion 22 (45) is constituted by the chamfered portions 19D, 21B (51D, 43B) was explained. However, other than the chamfered portions, various kinds of non-circular portions (for example, projections, recessed portions, corner portions, stepped portions, engagement holes or the like) which can be engaged with each other may be provided on the driving bush and washer of the present invention.

Further, in the third embodiment, an example that the engagement portion 44 is constituted by the engagement groove 41E of the rotary shaft 41 and the protrusion 43C of the washer 43 was explained. However, the present invention is not limited to such an example, but, for example, a protrusion may be provided in the leading end of the rotary shaft and an engagement groove may be formed in the surface of the washer, and these protrusion and engagement groove may constitutes an engagement portion. Further, other than the protrusion and engagement groove, an engagement portion may be constituted by various kinds of non-circular portions (for example, projections, recessed portions, corner portions, stepped portions, engagement holes or the like) which can be engaged with each other.

Further, in the above-mentioned embodiments, while an example that the scroll type air compressor is described as the scroll type fluid machine was explained, the present invention is not limited to such an example, but, the present invention can be widely applied to a vacuum pump, a coolant compressor and the like, for example.

Further, in the above-mentioned embodiments, while an example that the rotary shaft 16 (41) and the driving bush 19 (31, 51) are attached to each other by the attachment bolt 23 (46) was explained, such attaching means is not limited to the bolt, but, for example, the rotary shaft and the driving bush may be attached to each other by pin/hole press fit or may be attached to each other in such a manner that, after a male threaded portion formed on the leading end portion of the rotary shaft 16 is inserted through the shaft hole 19A, the leading end portion is fixed with respect to the driving bush by means of a nut. In the latter case, it is desirable that a key is provided in the shaft hole and a key way is provided in the rotary shaft in order to prevent the rotary shaft 16 from being rotated within the shaft hole 19A.

In the above-mentioned embodiments, while an example that the orbit bearing 24 is positioned within the boss portion 19B of the driving bush 19 and the connection portion 4C of the orbiting scroll 4 is press-fitted into the orbit bearing 24 was explained, the present invention is not limited to such an example, but, a boss portion may be provided in the orbiting scroll and an orbit bearing may be press-fitted into the boss portion and the driving bush 19 may be press-fitted into the orbit bearing.

Although only some exemplary embodiments of this invention have been described in detail above, those skilled in the art will readily appreciate that many modifications are possible in the exemplary embodiments without materially departing from the novel teaching and advantages of this invention. Accordingly, all such modifications are intended to be included within the scope of this invention.

The entire disclosure of Japanese Patent Application No. 2006-099485 filed on Mar. 31, 2006 including specification, claims, drawings and summary is incorporated herein by reference in its entirety.

What is claimed is:

1. A scroll type fluid machine including a casing, a fixed scroll provided on said casing and having an end plate and a spiral wrap portion extending from said end plate, and an orbiting scroll opposed to said fixed scroll within said casing and having an end plate and a spiral wrap portion extending from said end plate, said wrap portion of said orbiting scroll overlapping said wrap portion of said fixed scroll, said scroll type fluid machine comprising;

a rotary shaft which has one end attachable to an output shaft of a rotating drive source and a sub weight which is protruded radially from said one end of said rotary shaft;

a main bearing adapted to rotatably support said rotary shaft and having an outer periphery which is attached to said casing and an inner periphery into which the other end of said rotary shaft is inserted from a rotating drive source side of said main bearing;

a driving bush which is non-rotatably attached to said other end of said rotary shaft from an orbiting scroll side of said main bearing and to which said orbiting scroll is attached via an orbit bearing at a position eccentric radially from an axis of said rotary shaft; and a counter weight provided on said driving bush;

wherein said sub weight is protruded from said rotary shaft in the same direction as an eccentric direction of said orbiting scroll, a dimension of a portion of said sub weight protruded from said rotary shaft is larger than an inner diameter of said main bearing, and said sub weight has a center of gravity located at a position eccentric radially from an axis of said rotary shaft in the protruded direction of said sub weight; and wherin said counter weight has a center of gravity located at a position eccentric radially from said axis of said rotary shaft in a direction opposite to the eccentric direction of said orbiting scroll.

2. A scroll type fluid machine according to claim 1, wherein said driving bush has a shaft hole into which said other end of said rotary shaft is inserted, said rotary shaft being non-rotatable within said shaft hole.

3. A scroll type fluid machine according to claim 2, wherein said driving bush is provided with a washer attachment groove formed around said shaft hole, and said machine further comprises:

a washer having a bolt receiving hole at a position eccentric radially from said axis of said rotary shaft, said washer being received in said washer attachment groove;

an engagement portion provided between said driving bush and said washer, said engagement portion being adapted to prevent said driving bush and said washer from rotating relative to each other; and an attachment bolt inserted through said bolt receiving hole and screwed into said other end of said rotary shaft.

4. A scroll type fluid machine according to claim 3, further comprising another engagement portion provided between said rotary shaft and said washer and adapted to prevent said rotary shaft and said washer from rotating relative to each other.

5. A scroll type fluid machine according to claim 3, wherein said driving bush is provided with a boss portion to which said orbiting scroll is attached via an orbit bearing and is designed so that inner diameters of said boss portion, said washer attachment groove and said shaft hole are reduced in order.

6. A scroll type fluid machine according to claim 1, wherein said main bearing comprises two ball bearings each having an inner race and an outer race, said two ball bearing are arranged side by side in an axial direction, and wherein said two inner races are gripped in the axial direction by a force for attaching said driving bush to said rotary shaft.

7. A scroll type fluid machine according to claim 1, wherein said boss portion of said driving bush is provided at its inner periphery with a straight portion extending in parallel with a diametrical line connecting a center of said shaft hole and a center of said boss portion.

8. A scroll type fluid machine according to claim 1, wherein said counter weight is integrally formed with said driving bush.

* * * * *